US007451799B2

(12) United States Patent
Sanchez

(10) Patent No.: US 7,451,799 B2
(45) Date of Patent: Nov. 18, 2008

(54) SELF-LOCKING DEVICE FOR BLINDS AND SHUTTERS

(76) Inventor: Miguel Emper Sanchez, Carretera Madrid-Valencia NIII, Km 154, La Almarcha 16740, Cuenca (ES)

( * ) Notice: Subject to any disclaimer, the term of this patent is extended or adjusted under 35 U.S.C. 154(b) by 361 days.

(21) Appl. No.: 11/451,831

(22) Filed: Jun. 13, 2006

(65) Prior Publication Data

US 2006/0283558 A1 Dec. 21, 2006

(30) Foreign Application Priority Data

Jun. 17, 2005 (ES) ..... 200501490

(51) Int. Cl.
*E06B 9/08* (2006.01)

(52) U.S. Cl. ..... 160/133; 160/291; 160/300; 160/302; 160/298; 160/299; 160/321; 192/223.1; 192/223; 192/223.4

(58) Field of Classification Search ..... 160/291, 160/300, 302, 298, 299, 321, 133, 188, 235; 192/223, 223.1, 223.4
See application file for complete search history.

(56) References Cited

U.S. PATENT DOCUMENTS 541,696 A * 6/1895 Spaulding ..... 160/267.1
705,553 A * 7/1902 Blake ..... 160/133
4,125,231 A * 11/1978 Henderson ..... 242/375.3
4,128,120 A * 12/1978 Frey ..... 160/191
4,476,910 A * 10/1984 Saito ..... 160/291
4,986,331 A * 1/1991 Henkenjohann ..... 160/201
5,494,093 A * 2/1996 Eiterman ..... 160/300
5,722,476 A * 3/1998 Lujan-Sanchez et al. .... 160/133
6,378,594 B1 * 4/2002 Yamanaka et al. ..... 160/238
6,401,792 B1 * 6/2002 Mullet et al. ..... 160/188
6,637,575 B2 * 10/2003 Liu et al. ..... 192/223.2
6,640,496 B2 * 11/2003 Mullet ..... 49/199
6,712,116 B2 * 3/2004 Beaudoin et al. ..... 160/188
7,032,937 B2 * 4/2006 Boecker et al. ..... 292/201

FOREIGN PATENT DOCUMENTS

EP 1612368 1/2006

* cited by examiner

*Primary Examiner*—Katherine W Mitchell
*Assistant Examiner*—Philip S Kwon
(74) *Attorney, Agent, or Firm*—John C. McMahon

(57) ABSTRACT

Which has the following essential elements:

A drive shaft (1) joined to the rolling drum (23) of a blind (21), joined by means of a first freewheel mechanism (2) with a drive cylinder (4) which has a freeing sector (5).

A cogged wheel (17) which has protuberances (18) into which fit the relevant extensions (19) of the slats (20) of the blind (21), joined via a second freewheel mechanism (15) with a blocking sector (26).

A brake cylinder (7) with teeth (27) housing a brake spring (9) whose ends form stops (10), with the blocking sector (25) acting on the stops (10) in the direction to increase the apparent diameter of the brake spring (9) and the freeing sector (5) in the direction to reduce its apparent diameter.

Various ratchets (28) that can lock against the teeth (27) as a function of the relative position of a transmission crown (6) on which they are articulated with respect to the drive cylinder (4).

2 Claims, 5 Drawing Sheets

SELF-LOCKING DEVICE FOR BLINDS AND SHUTTERS

This invention refers to certain improvements that increase the security of devices to unlock blinds and shutters designed to prevent entry through doors, windows or any other type of openings usually found in the facades of buildings.

In recent times, security against intrusions into buildings has become a priority need. Usually, various devices are used to achieve the required security ranging from alarms to fixed or removable physical barriers such that either an intrusion is detected or it is made impossible or at least difficult.

For a long time, devices have been known that are based on a blind consisting of slats rolled on a rotating drum that allows doors, windows, shop windows and other openings in the facades of buildings to be completely covered. These devices are based on a very simple mechanism in which the blind is rolled on a rotating drum when it is lifted while the descent is made by gravity due to the weight of the blind which is unrolled from the drum as the latter allows. This asymmetrical operation of the device causes problems for stopping a blind in a secure position since, although the movement mechanism cannot be reversed, it is always possible to raise the blind manually from the exterior.

As a result, it would be desirable to have a braking device that provides mechanical locking of the blind automatically without the user's involvement. The device should act independently of the operating of the movement mechanism so that the latter need not be mechanically irreversible.

Document ES 200401582, of the applicant himself, describes such a device consisting of incorporating a locking mechanism, independent of the movement mechanism, consisting of a cogged wheel that can retain extensions conveniently placed on the end of the slats in the blind and which move through the customary vertical side guides. The cogged wheel is in turn connected to a braking mechanism which is that which, in reality, locks the blind when an attempt is made to lift it manually (in the following, and in the context of this document, "blind" is understood as any closing device based on slats).

This device is described in detail to show the operation and transcendence of the improvements now proposed.

The braking mechanism described above consists of a spring, made of steel wire, preferably with a rectangular cross-section, with several windings arranged axially on the same diameter, its ends being bent radially to form stops. At rest, the diameter of the spring is greater than that of the circular interior housing of a fixed brake cylinder, so that it must be inserted into it by rotating the spring stops in opposite directions and in the suitable direction to reduce its diameter. The geometrical line which joins the bent ends that form the stops divides the interior circle of the spring into two sector housings. In one of these an interlocking sector is inserted and in the other, a freeing sector. It can be seen that the operation of the mechanism is based on the fact that the braking spring increases or reduces its diameter according to whether the stops are moved in one direction or the other. The tendency to increase or decrease the spring's diameter causes it to lock or free in respect of the interior housing of the brake cylinder.

In a preferred embodiment, the transmission mechanism that relates the cogged wheel with the braking mechanism consists of the above mentioned interlocking sector which forms part of a transmission crown which, through a pinion and auxiliary crown, transmits the movement to a locking shaft joined to the cogged wheel.

The descending movement is made by gravity and, so that this is possible, it is necessary that the extensions to the slats in the blind can turn the cogged wheel during their descending movement. The proposed solution consists of providing a freewheel mechanism between the cogged wheel and the braking mechanism.

During the lifting movement, it must be possible to move the cogged wheeled in a direction in which it must remain locked by the braking spring. To solve this problem, two new concepts are introduced in the device.

The first consists of disabling the braking mechanism during the movement, which is achieved by making driving shaft connected to the blind's rolling drum move a driving cylinder that provides a freeing sector that is placed between the braking spring stops and moves them in the direction that reduces the spring's diameter. Thus, during the lifting movement, the cogged wheel is no longer braked but moves with a speed that depends on that of the drive shaft and is determined by a transmission mechanism.

The second new concept solves the problem caused by the fact that the linear speed of the blind varies for the same speed of the rolling drum because during the lifting movement, the blind is rolled up on itself and, as a result, the apparent diameter which defines its linear speed increases progressively. The proposed solution consists of the sizing of the various elements of the transmission mechanism that connects the drive shaft with the cogged wheel so that the latter tries to move at a speed that is clearly greater than that which it would have if it were connected with the blind slats through their extensions. Thus, the rotation of the cogged wheel undergoes a slippage that is made possible by the freewheel mechanism.

Finally, and given that the drive shaft is connected to the freeing sector of the drive cylinder brake spring, it is necessary to insert another freewheel mechanism between them to prevent the freeing of the brake spring and the cogged wheel from trying to turn, dragging the blind downward at a constant speed that is very much higher than that allowed by the movement of the drive shaft, during the descending movement.

As a result, there is a clear synergy between the various elements described in ES 200401582 which are:

- A drive shaft joined to the blind's rolling drum, joined through a first freewheel mechanism with the drive cylinder that has a freeing sector.
- A cogged wheel with protuberances, between which the relevant extensions of the slats in the blind fit and that is joined through a second freewheel mechanism and various transmission elements with a locking sector.
- A brake spring with various windings distributed axially on the same diameter and whose radially bent ends form stops that define two sector housings that are designed to receive the drive cylinder freeing sector and the transmission crown locking sector.

The advantages of such a system are, basically:

The blind is locked at the end of a total or partial lowering operation.

The locking of the blind occurs even though the handling device is not mechanically irreversible.

The blind is locked in any intermediate point in a raising or lowering operation, allowing it to permit the passage of light and air.

The locking occurs automatically. The blind is always locked in any position in which it is left. It is not necessary to carry out any additional operation so that it is not possible to forget to lock the blind.

However, in the practical manufacture of the device described, it has been shown that if a sufficiently high effort is applied to the blind, it may be possible to move it. This is because, in the device just described, the blind is locked due to the friction of the brake spring against the interior surface of its housing. It is clear that the various elements may be sized such that the effort necessary for the locking to fail due to friction would be abnormally high but there will always be reasonable doubt due to the braking principle itself.

As a result, it is an aim of this invention to improve the described device to ensure a mechanical locking that cannot be overcome except by the breakage of the various parts involved.

In order to reach the proposed aim, it has been decided to replace the principle of breaking by friction for mechanical locking using ratchets. The friction braking mechanism has not disappeared but now forms the means of controlling the movement of the locking and unlocking of the ratchets. Specifically, the following structural changes have been incorporated:

The fixed braking cylinder, inside which the spring fits, has been equipped with exterior teeth around its periphery.

Various articulated ratchets have been added to the transmission crown, fitted with guides that pass through windows opened in the crown itself, such that the ends of the ratchets fit into the peripheral teeth on the braking cylinder.

The drive cylinder has been fitted with wings with openings to receive and guide the guides on the ratchets while the freeing sector now houses one of the brake spring stops in order to reduce free play during its operation to the minimum.

Thus, the relative movement of the drive cylinder (which contains the holes) with respect to the transmission crown (on which the ratchets are articulated) causes the latter to turn and then to lock or unlock on the teeth on the brake cylinder (fixed).

To complete the above description and to help gain a better understanding of the features of the invention, a detailed description is given of the preferred embodiment on the basis of a set of drawings that accompanies this description and in which the following is shown purely for orientation and not for limitation:

Figure 1:
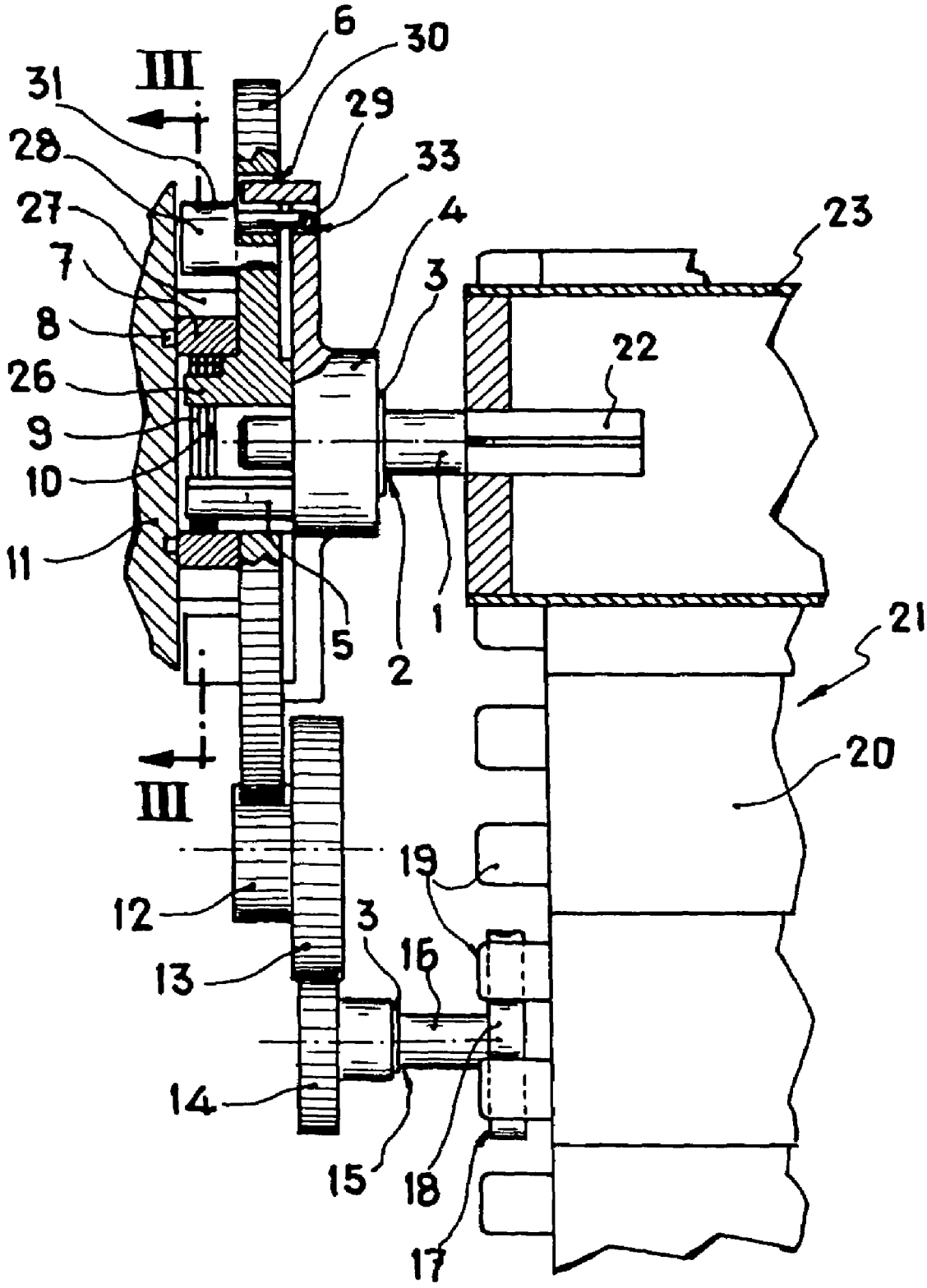
FIG. 1 shows an elevation view of the device in the invention with various cross sections to show details of the braking and anchoring mechanism for the rolling drum.

In these figures, the numbers refer to the following a parts and elements:

1. Drive shaft.
2. First freewheel mechanism.
3. Exterior bush for the freewheel mechanisms.
4. Drive cylinder.
5. Freeing section of drive cylinder (4)
6. Transmission crown.
7. Brake cylinder.
8. Studs on brake cylinder (7)
9. Brake spring.
10. Stops on brake spring (9).
11. Casing.
12. Auxiliary pinion.
13. Auxiliary crown.
14. Transmission pinion.
15. Second freewheel mechanism.
16. Locking shaft.
17. Cogged wheel.
18. Protuberances.
19. Extensions.
20. Slats.
21. Blind.
22. Square bar.
23. Blind rolling drum (21).
26. Locking sector.
27. Teeth.
28. Ratchets.
29. Guides.
30. Openings.
31. Ends of ratchets (28).
32. Drive cylinder wings (4).
33. Holes in wings (32).
34. Slot.

As can be seen in FIGS. 1 to 4, the device in the invention consists of a drive shaft (1) operating in both rotational directions that can rotate inside a first freewheel mechanism (2) of which the exterior bush (3) is press fitted to the interior diameter of the drive cylinder (4) which has a freeing section (5) on one of one of its faces.

The transmission crown (6) on the drive shaft (1) can rotate freely and has a locking sector (26) and a sector housing that receives the freeing sector (5) of the drive cylinder (4) with free play, with which the transmission crown (6) and the drive cylinder (4) turn together, except for a certain intentional free play between the freeing sector (5) and its housing in the transmission crown (6).

A brake disc (7) joined to the casing (11) of the device thanks to two studs (8) has a circular housing with a brake spring (9). This spring, made of rectangular cross section steel wire, has various turns distributed axially on the same diameter and its ends, radially bent, form stops (10). At rest, its diameter is greater than that of the circular housing in the brake disc (7) so that it must be inserted in the latter after the stops (10) have been rotated in opposite directions and in the suitable direction to reduce its diameter, as shown with A in the detail in FIG. 3. Any attempt to move the stop (10) in the opposite direction, B, will cause the locking of the friction spring (9). The brake cylinder (7) has asymmetric teeth (27) on its exterior periphery. See FIGS. 1, and 3 to 5.

Figure 3:
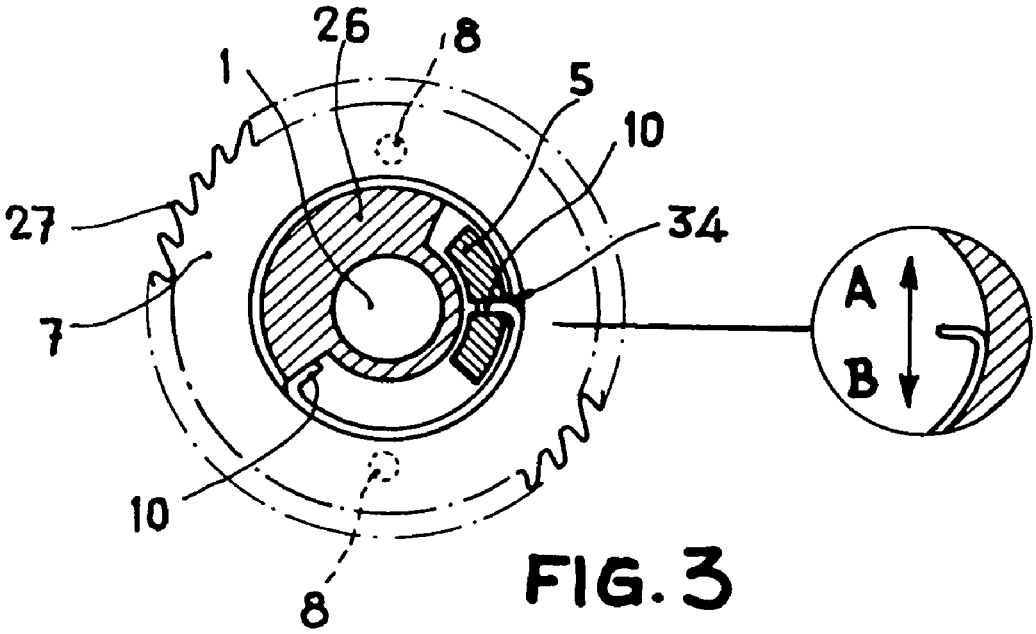
FIG. 3 shows a schematic cross section through the line III-III in FIG. 1.
Figure 4:
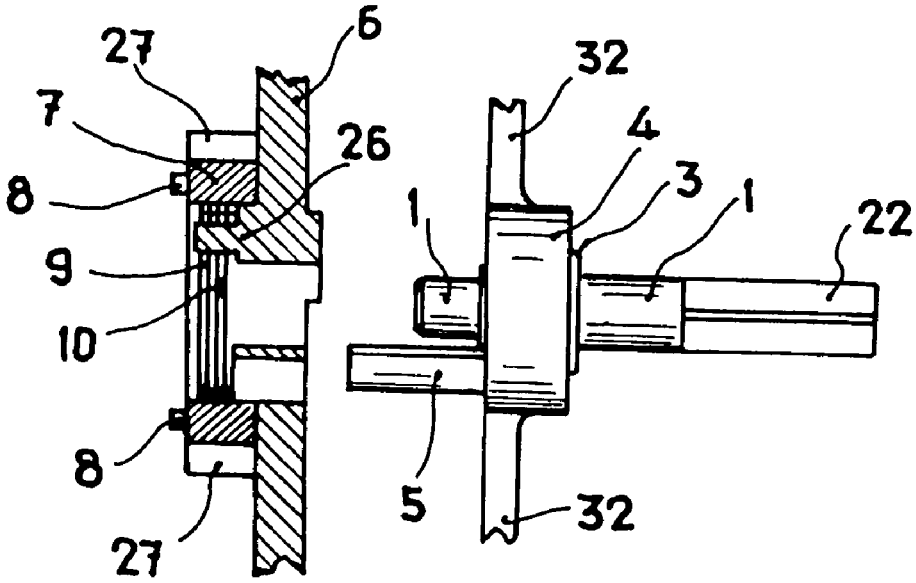
FIG. 4 shows a detail of the friction brake mechanism, similar to that shown in FIG. 1, with an exploded view of the drive shaft.
Figure 5:
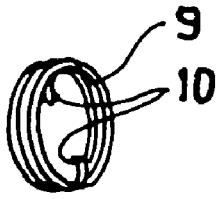
FIG. 5 shows a perspective view of the brake spring.
Figure 9:
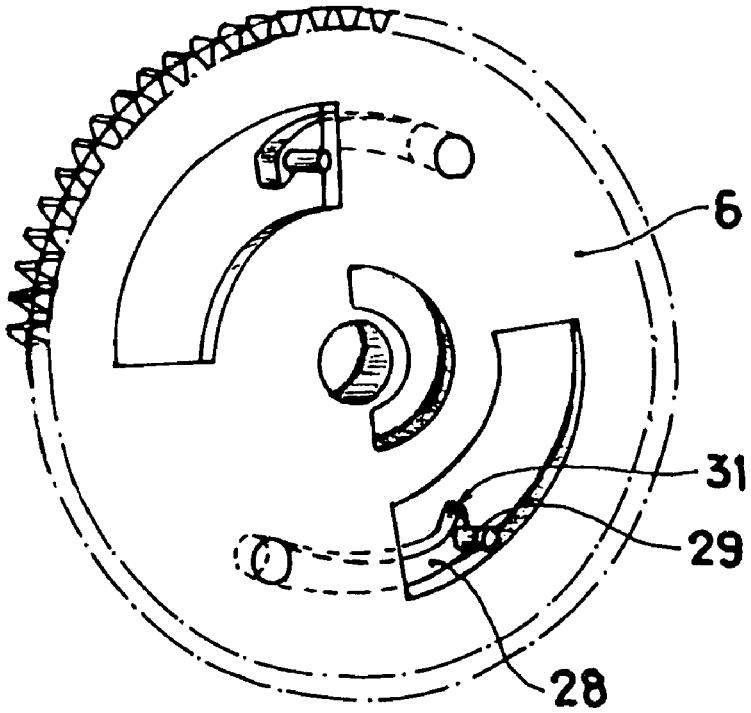
FIG. 9 shows a perspective view of the transmission crown with the articulated ratchets on it.

The transmission crown (6) has a locking sector (26) on one of its front faces that is housed between the stops (10) of the brake spring (9) on the side opposite to the freeing sector (5) as shown in FIGS. 1 and 3. Various articulated ratchets (28) are fitted onto the transmission crown (6), equipped with cylindrical guides (29) which pass through openings (30) in the transmission crown (6), with the ends (31) of the ratchets (28) being able to fit into the peripheral teeth (27) on the brake cylinder (7). See FIG. 9.

The outside of the transmission crown (6) engages with an auxiliary pinion (12) joined to an auxiliary crown (13) which in turn engages with a transmission pinion (14) joined to the outer bush (3) of a second freewheel mechanism (15) inside which a locking shaft (16) turns (only in one direction and not in the other), joined to a cogged wheel (17). This has a number of protuberances (18) on its periphery, suitably spaced so that the extensions (19) of the slats (20) of a blind (21) fit between them when these extensions move linearly or along conventional guides, not shown. See FIGS. 1 and 2.

There are wings (32) on the drive cylinder (4) with openings (33) to receive and guide the relevant guides (29) on the ratchets (28). The freeing sector (5) has a slot (34) into which one of the stops (10) on the brake spring (9) fits in order to reduce the free play during operation to the minimum.

Figure 6:
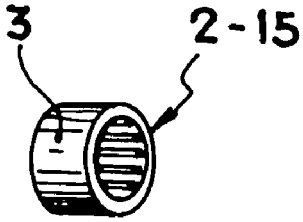
FIG. 6 shows a perspective view of one of the freewheel mechanisms.

FIG. 6 shows a commercial freewheel mechanism used in the preferred embodiment, which appears as a conventional needle bearing. An asymmetric separator, not visible, allows the needles to rotate with respect to the outer bush (3) in one direction (that of freewheeling) but not in the other direction.

Figure 7:
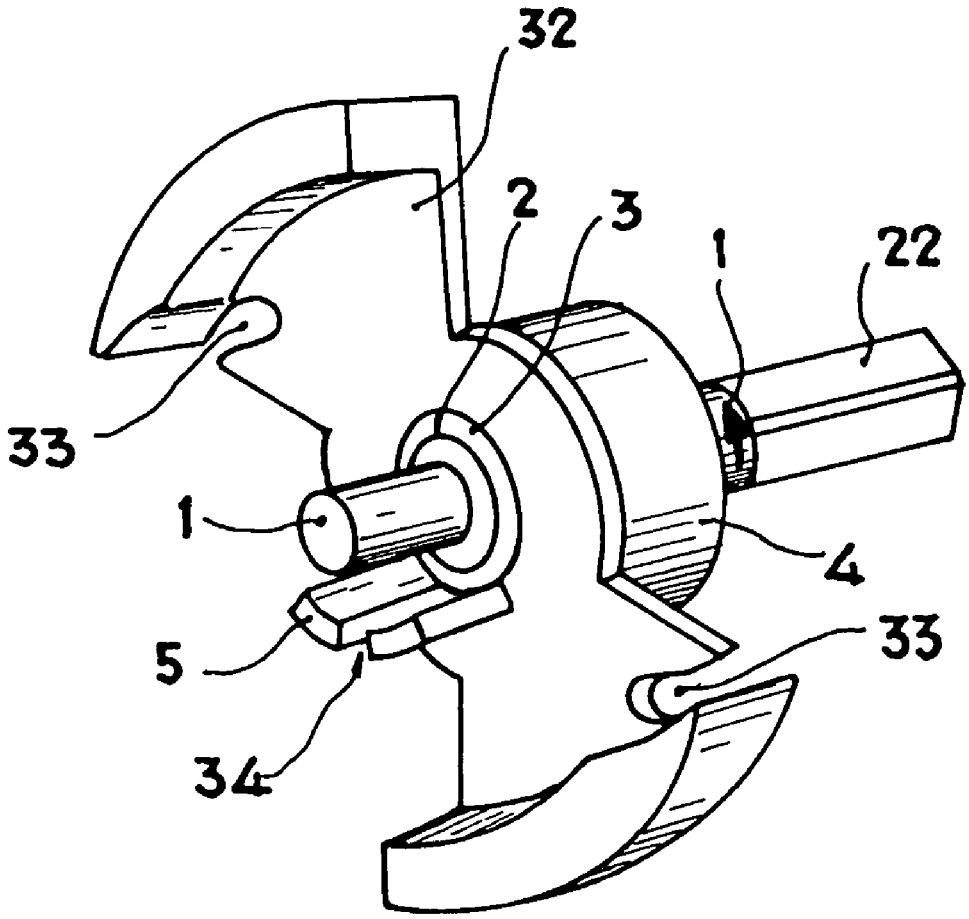
FIG. 7 shows a perspective view of the assembly formed by the drive shaft and drive cylinder, joined by the first freewheel mechanism.
Figure 8:
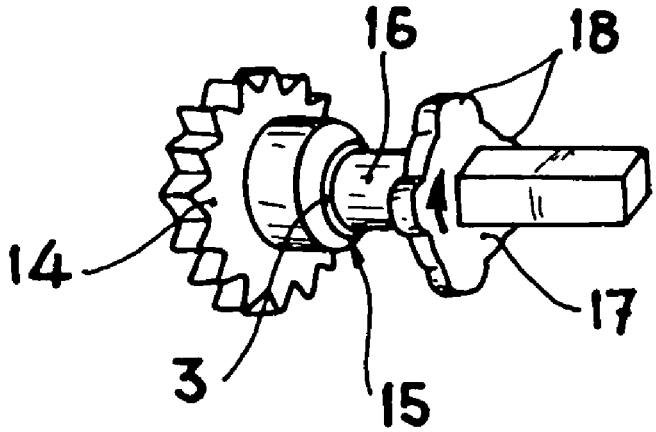
FIG. 8 shows a perspective view of the assembly formed by the cogged wheel and the transmission pinion, joined by the second freewheel mechanism.

In order to facilitate the understanding of the device, FIGS. 7 and 8 show perspective views of the arrangement of the first freewheel mechanism (2) and the second freewheel mechanism (15) on the drive shaft (1) and the locking shaft (16), respectively. Arrows in both figures show the relative movements allowed by the respective freewheel mechanisms.

Figure 2:
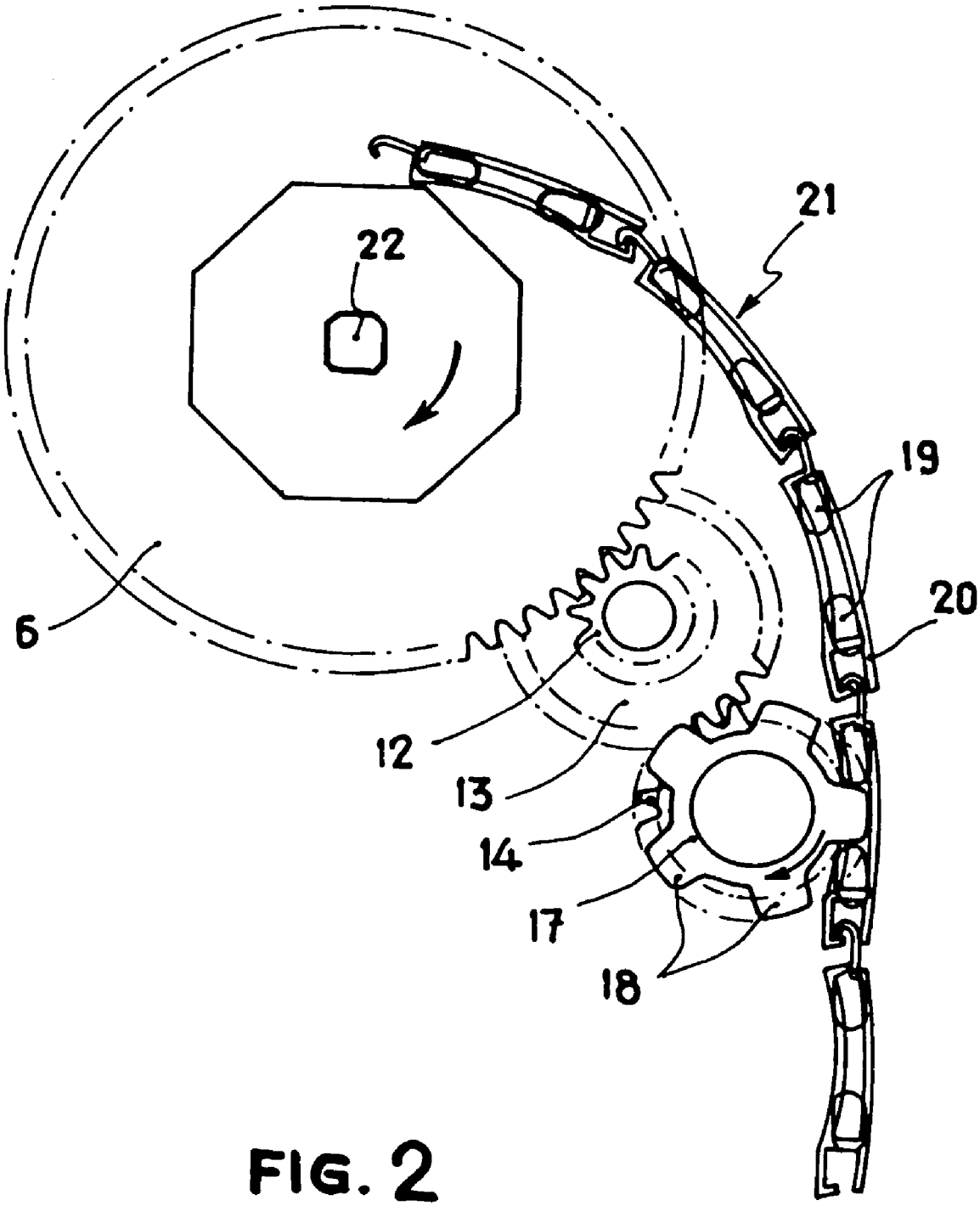
FIG. 2 shows a side view.

The operation of the self-locking mechanism which is the object of the invention is as follows. During the lowering movement, the drive shaft (1) rotates, by means of the square bar (22) the rolling drum (23) which frees the blind (21), allowing it to descend by gravity. In FIG. 2, the arrows show the rotational direction allowed by the freewheel mechanisms (2) (15) so that, as can be seen, the blind (21) can descend, freely turning the cogged wheel (17). The transmission pinion (14), the auxiliary crown (13), the auxiliary pinion (12) and the transmission crown (6) that form the transmission mechanism remain immobile since the locking sector (26) on the transmission crown (6) is retained by the stops (10) on the brake spring (9) which firmly presses against the brake cylinder (7), as can be seen in FIG. 3.

Figure 10:
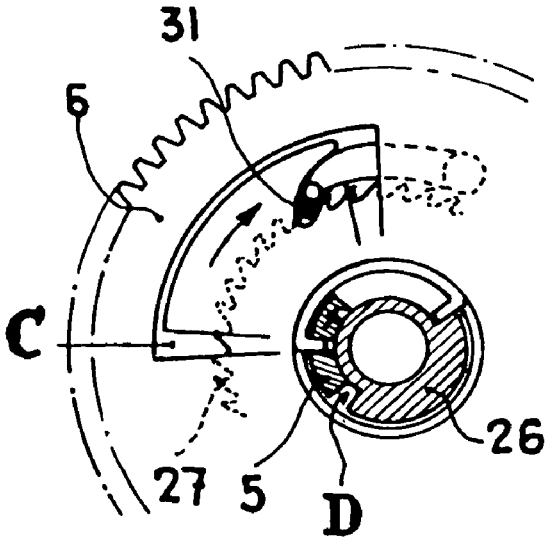
FIG. 10 is a detailed schematic drawing of the device in the locked position.

During the raising movement, the first freewheel mechanism (2) remains locked so that the drive shaft (1) moves the drive cylinder (4) anti-clockwise and its freeing sector (5) turns the brake spring (9) in the direction that reduces its apparent diameter, which allows it to slip with respect to the brake cylinder (7). This small relative movement of the drive cylinder (4) with respect to the transmission crown (6) frees the ratchets (28), as shown in FIG. 10, allowing the transmission crown (6) to turn which, through the auxiliary pinion (12), the auxiliary crown (13) and the transmission pinion (14), transmits the movement to the outer bush (3) of the second freewheel mechanism (15). As a result, the cogged wheel (17) must move upward at a speed determined by the sizes of the various elements in the transmission mechanism. However, the speed of movement of the cogged wheel (17) is defined by the blind (21) itself as it rolls up, to a value that is clearly less than that determined by the size of the transmission mechanism. That is, relative slippage occurs between the locking shaft (16) joined to the cogged wheel (17) and the transmission pinion (14), precisely in the direction allowed by the second freewheel mechanism (15).

With regard to the self-locking of the device in the invention, it can be seen that if an attempt is made to force the blind (21) by pushing it upward, the cogged wheel (17) will try to turn in the anti-clockwise direction, locking the second freewheel mechanism (15) and transmitting a force through the locking shaft (16), transmission pinion (14), auxiliary crown (13), auxiliary pinion (12), transmission crown (6), locking sector (26) and stops (10) on the brake spring (9), jamming firmly against the brake cylinder (7), which is itself immobilised with respect to the casing (11) by the studs (8). The small relative movement of the transmission crown (6) with respect to the drive cylinder (4), immobilised by the break spring (9), will lock the ratchets (28) against the teeth (27) on the brake cylinder (7), preventing the movement of the transmission crown (6) and of the slats (20) of the blind (21). See FIGS. 1, 2 and 10.

Figure 11:
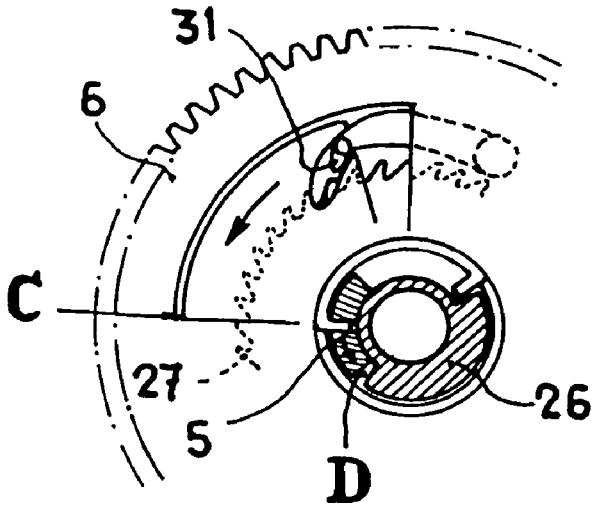
FIG. 11 is a detailed schematic drawing of the device in the unlocked position.

The detail in FIG. 10 shows the large clearances C and D that appear between the crown and (6) and the drive cylinder (4) when the latter moves with respect to the former in the clockwise direction during the locking of the ratchets (28). On the other hand, FIG. 11 shows how these clearances C and D are reduced until they almost disappear when the drive cylinder (4) moves with respect to the crown (6) in the anti-clockwise direction, which causes the unlocking of the ratchets (28). This small relative movement between both elements is what causes the locking or unlocking of the device.

Other modifications and alternatives to the preferred embodiment in order to adapt the device to various conditions of effort, costs and manufacturing means will be evident to an expert in the matter. Thus, a specific freewheel mechanism has been used that is usually offered commercially but any other with the required function could equally be used, even if its form did not exactly match that shown in FIG. 6. The locking sector (26) and the freeing sector (5) have been shown as limited by circular surfaces but this need not be obligatory. Finally, the transmission mechanism need not necessarily include an auxiliary pinion (12) and an auxiliary crown (13) but may include a variable number of gears or equivalent devices according to specific constructional variables, especially in the distance between the drive shaft (1) and the locking shaft (16).

To facilitate the understanding of the invention, only those elements that are essential to it have been shown, omitting other necessary but known elements such as the casing, bearings, means of fixing, etc. Likewise, the figures are intended to be as intuitive as possible even at the cost of slightly sacrificing the fidelity of their representation.

The invention claimed is:

1. Improved self-locking device for blinds (21) and shutters of the type that include:

- a drive shaft (1) operateable in both rotational directions,
- a rolling drum (23) for a blind (21) rotating together with the drive shaft (1),
- a first freewheel mechanism (2) in which the drive shaft (1) revolves and whose outer bush (3) is joined to a drive cylinder (4) which has a freeing sector (5),
- a second freewheel mechanism (15) in which a locking shaft (16) revolves and whose outer bush (3) is joined to a transmission pinion (14),
- a cogged wheel (17) joined to the locking shaft (16) that has a number of protuberances (18) on its periphery, suitably spaced so that extensions (19) to slats (20) on the blind (21) fit into them,
- a transmission crown (6) rotating freely on the drive shaft (1) with a locking sector (26) on one of its faces and with a housing to receive the freeing sector (5) on the drive cylinder (4) with a certain clearance,
- a braking mechanism consisting of a brake spring (9) formed by various turns of elastic wire distributed axially on the same diameter with its ends bent radially to form stops (10), the brake spring (9) being firmly housed inside a brake cylinder (7) joined to a casing (11) of the device, the locking sector (26) acting on the stops (10) in a first direction and the freeing sector acting on the stops (10) in a second direction, said second direction being opposite of the first direction, to increase the apparent diameter of the brake spring (9), and the locking sector (26) acting on the stops (10) in the second direction and the freeing sector acting on the stops in the first direction to decrease the apparent diameter of the brake spring, a transmission mechanism that joins the transmission crown (6) to the transmission pinion (14), characterised in that it comprises:

a number of teeth (27) on the periphery of the brake cylinder (7), multiple articulated ratchets (28) on the transmission crown (6) each equipped with a respective guide (29) which pass through a respective opening (30) in the transmission crown (6) itself, with a respective end (31) of each ratchet (28) being able to be housed in the teeth (27) on the brake cylinder (7), wings (32) on the drive cylinder (4) with a respective hole (33) to receive and guide the respective guide (29) on the respective ratchet (28), a slot (34) in the freeing sector (5) on the drive cylinder (4) which closely grips one of the stops (10) on the brake spring (9).

2. Improved self-locking device for blinds (21) and shutters according to claim 1, characterised in that the transmission mechanism includes an auxiliary pinion (12) which engages with the transmission crown (6) and is joined to an auxiliary crown (13) which engages with the transmission pinion (14).

* * * * *